US008919934B2

(12) United States Patent
Ikegawa et al.

(10) Patent No.: US 8,919,934 B2
(45) Date of Patent: Dec. 30, 2014

(54) INKJET RECORDING APPARATUS

(71) Applicant: Hitachi Industrial Equipment Systems Co., Ltd., Tokyo (JP)

(72) Inventors: Masato Ikegawa, Tsuchiura (JP); Eiji Ishii, Hitachinaka (JP); Nobuhiro Harada, Hitachi (JP); Tsuneaki Takagishi, Hitachi (JP)

(73) Assignee: Hitachi Industrial Equipment Services Co., Ltd., Tokyo (JP)

( * ) Notice: Subject to any disclaimer, the term of this patent is extended or adjusted under 35 U.S.C. 154(b) by 31 days.

(21) Appl. No.: 13/770,205

(22) Filed: Feb. 19, 2013

(65) Prior Publication Data

US 2013/0314462 A1 Nov. 28, 2013

(30) Foreign Application Priority Data

May 22, 2012 (JP) ..... 2012-116373

(51) Int. Cl.

| | |
|---|---|
| ***B41J 2/09*** | (2006.01) |
| *B41J 2/02* | (2006.01) |
| *B41J 2/07* | (2006.01) |
| *B41J 2/085* | (2006.01) |
| *B41J 2/12* | (2006.01) |
| *B41J 2/115* | (2006.01) |
| *B41J 2/125* | (2006.01) |
| *B41J 2/105* | (2006.01) |
| *B41J 2/215* | (2006.01) |

(52) U.S. Cl.

CPC ..... *B41J 2/09* (2013.01); *B41J 2/07* (2013.01)
USPC ..... 347/77; 347/73; 347/74; 347/75; 347/76; 347/78; 347/79; 347/80; 347/81; 347/82; 347/83

(58) Field of Classification Search

CPC ..... B41J 2/02; B41J 2/025; B41J 2/03; B41J 2/075; B41J 2/085; B41J 2/09; B41J 2/95; B41J 2/115; B41J 2/12; B41J 2/185; B41J 2/185
USPC ..... 347/73–83
See application file for complete search history.

(56) References Cited

U.S. PATENT DOCUMENTS 3,512,173 A * 5/1970 Damouth ..... 347/76
3,981,019 A * 9/1976 Fujimoto et al. ..... 347/80

(Continued)

FOREIGN PATENT DOCUMENTS

| | | | |
|---|---|---|---|
| JP | 61-120766 | A | 6/1986 |
| JP | 04-292951 | A | 10/1992 |
| JP | 2002-264339 | A | 9/2002 |

*Primary Examiner* — Alessandro Amari
*Assistant Examiner* — Jeremy Bishop
(74) *Attorney, Agent, or Firm* — Mattingly & Malur, PC

(57) ABSTRACT

A voltage is applied between first and second deflecting electrodes from a deflecting voltage controller, whereby an electric field is formed between the first and second deflecting electrodes in a direction perpendicular to electrode surfaces. An electric line of force is generated from a direction perpendicular to the electrode surface of the first deflecting electrode and made perpendicularly incident on the electrode surface of the second deflecting electrode. Since the first and second deflecting electrodes are parallel to each other, a plurality of parallel electric lines of force are formed perpendicularly to the electrode surfaces of the first and second deflecting electrodes. Droplets after passing charged electrodes fly in a region where this deflecting electric field is formed, whereby charged droplets are deflected in a direction in which the charged droplets approach the second electrode having opposite charging polarity. The charged droplets form a printing pattern.

7 Claims, 7 Drawing Sheets

(56) References Cited

U.S. PATENT DOCUMENTS 4,012,745 A * 3/1977 Brown et al. ..... 347/80
4,015,267 A * 3/1977 Kasubuchi et al. ..... 347/79
4,025,926 A * 5/1977 Fujimoto et al. ..... 347/80
4,346,387 A * 8/1982 Hertz ..... 347/75
4,408,211 A * 10/1983 Yamada ..... 347/75
7,393,086 B2 * 7/2008 Otte et al. ..... 347/77

* cited by examiner

INKJET RECORDING APPARATUS

BACKGROUND OF THE INVENTION

1. Field of the Invention

The present invention relates to an inkjet recording apparatus.

2. Description of the Related Art

Among inkjet recording apparatuses, a continuous ejection type inkjet recording apparatus is a highly stable droplet ejection apparatus having higher reliability and higher maintainability compared with an ondemand type inkjet apparatus used in a printer for home use or office use.

Therefore, the continuous ejection type inkjet recording apparatus can be applied to a manufacturing apparatus for an electronic apparatus for which functional ink application and patterning need to be performed using liquid. High reliability, high maintainability, and high stability are required for the manufacturing apparatus.

The continuous ejection type inkjet recording apparatus pressurizes, using a pump or the like, liquid (ink) stored in an ink tank and continuously ejects the liquid from fine nozzles. The nozzles are vibrated by excitation by a piezoelectric element or the like, fluctuation is applied to the liquid being ejected, and an ink column being ejected is cut to let fine droplets of the ink to fly. At this point, a charging electrode is arranged near a droplet forming position where the ink column is cut and an electric field is applied to the fine droplets of the ink to charge droplets to be formed.

A flying direction of the charged droplets is controlled according to presence or absence and the magnitude (field intensity) of an electric field generated by application of a voltage to a deflecting electrode arranged in a downstream position of the charging electrode (a deflecting process).

The deflecting process is roughly classified into two types, i.e., a multiple deflection type and a binary deflection type. In both types, a charging amount to the liquid (the ink) after ejection is controlled and used for deflection of the liquid. Therefore, discharge control for the droplets does not need to be performed for each of the droplets and the configuration of the apparatus is simplified. Since droplet ejection is continuously performed, nozzle clogging less easily occurs and high reliability can be secured.

However, in most continuous ejection type inkjet recording apparatuses, since an interval between the flying droplets are small, the following droplet combines (merges) with the preceding droplet or disperses (scatters) with Coulomb repulsion to cause an error (distortion) in printing. Therefore, a measure is taken to insert dummy uncharged droplets among charged droplets for printing. As a result, printing speed decreases.

Concerning determination of a droplet interval, it is theoretically known that an ejected liquid column (having a radius "a") is optimally split into droplets having the same diameter when there is a relation $k \cdot a = 1/(2)^{1/2}$ between the radius "a" and a wave number k of excitation. From this relation and a relation between the ink column to be split and a droplet volume, a relation between a droplet interval L and a droplet diameter d is L=2.36d. Therefore, when the droplet diameter d is determined, the droplet interval L is nearly determined.

In general, it is known that, when another particle flies within a distance **6*d*** behind a flying leading particle (having a diameter d), air resistance (drag) of the following particle decreases to 60 to 80%. Therefore, in the continuous ejection type inkjet recording apparatus, the following droplet catches up and combines with the leading droplet or disperses to cause distortion in printing.

Therefore, in the technique described in JPA61120766 (Patent Literature 1), the deflecting electrode on the ground side is extended in parallel to the deflecting electrode on the positive side in the ink droplet intrusion inlet direction to increase a charged droplet interval.

In the technique described in JPA04292951 (Patent Literature 2), the deflecting electrode on the positive side is obliquely arranged.

In the technique described in JPA2002264339 (Patent Literature 3), the downstream side of the deflecting electrode is formed obliquely along the deflection of the ink droplets.

However, in Patent Literature 1, although the electric field (the electric line of force) tilts with respect to the traveling direction of the ink droplets, since the electric line of force is made incident on the electrode vertically, such an electric field distribution is theoretically impossible. Usually, the continuous ejection type inkjet recording apparatus negatively charges droplets, makes ink incident near the ground electrode, and deflects the droplets in the direction of the positive electrode according to a charging amount. Therefore, in the vicinity of the ground electrode, since the electric line of force is made incident on the electrode vertically, a traveling direction acceleration effect by the electric field is hardly obtained.

In the deflecting electrode structure described in Patent Literature 2, the deflecting electrode surface on the negative side (or the ground side) near the ink droplet incident line is parallel to the ink droplet incident line. Therefore, since there is no electric field component in the traveling direction, an accelerating effect in the traveling direction is hardly obtained.

In the deflecting electrode structure described in Patent Literature 3, the electric field in the ink incident line direction acts as a brake to the contrary. Therefore, an accelerating effect in the traveling direction is hardly obtained.

SUMMARY OF THE INVENTION

It is an object of the present invention to realize an inkjet recording apparatus and an inkjet recording method capable of performing high speed printing without printing distortion.

In order to attain the object, the present invention is configured as explained below.

In the inkjet recording apparatus and the inkjet recording method, ink droplets are ejected from a nozzle head, a recording signal corresponding to recording information is generated from a deflecting voltage controller, the ink droplets are charged by a charging voltage controller on the basis of the recording signal, the charged ink droplets are made incident between a first deflecting electrode and a second deflecting electrode opposed to each other, an electric line of force inclining in a traveling direction of the ink droplets is formed with respect to a line orthogonal to an extended line in an ink droplet incident direction of the ink droplets between the first deflecting electrode and the second deflecting electrode, a flying direction of the charged ink droplets is deflected, and a character or the like is recorded on a recording object that moves in a direction substantially perpendicular to a deflecting direction.

According to the present invention, the object of the present invention can attain the inkjet recording apparatus and the inkjet recording method capable of performing high speed printing without printing distortion.

DETAILED DESCRIPTION OF THE INVENTION

Embodiments of the present invention are explained in detail with reference to the accompanying drawings.

First, an overall configuration of an inkjet recording apparatus to which the present invention is applied is explained.

Figure 7:
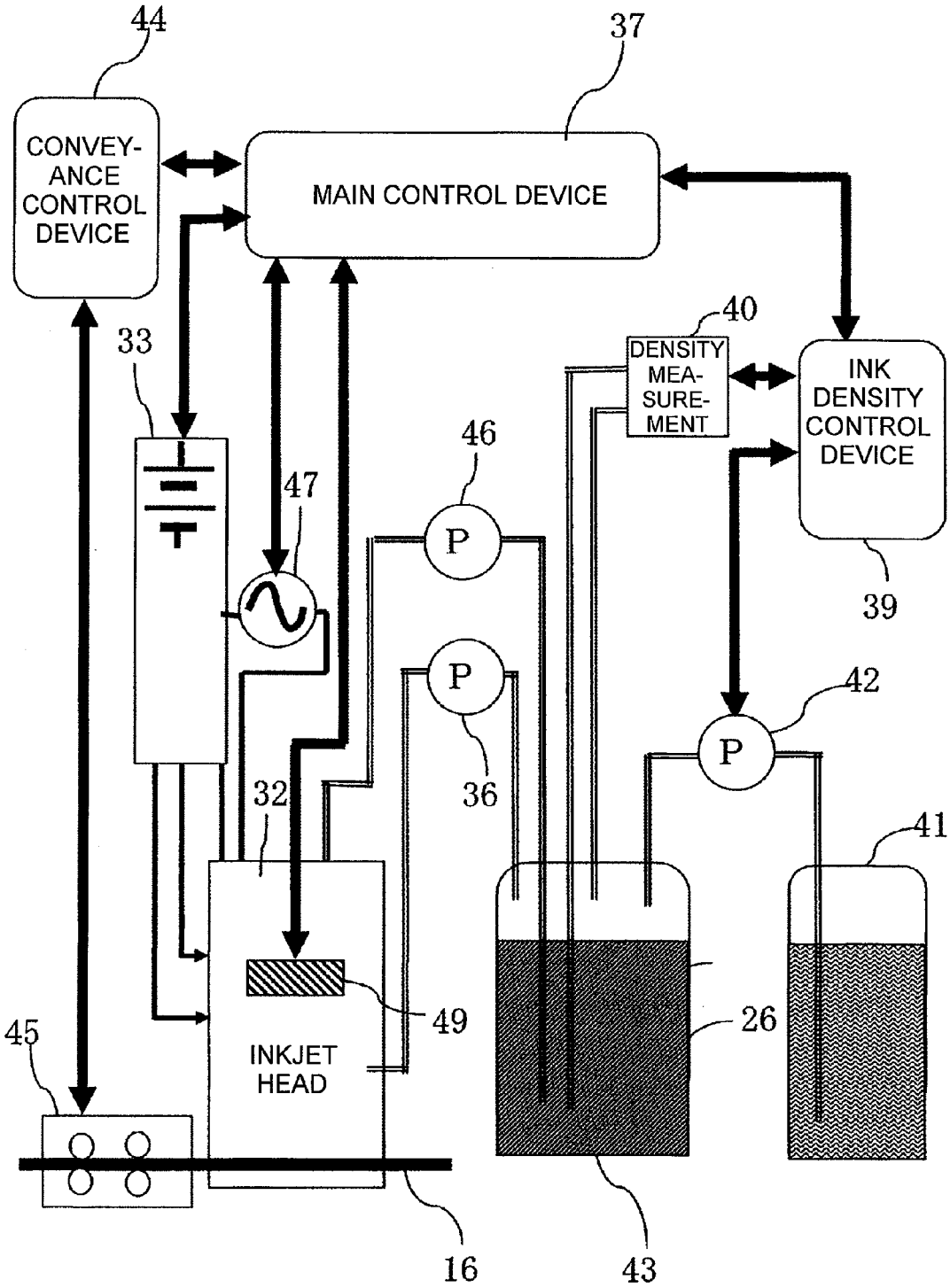
FIG. 7 is an overall schematic configuration diagram of an inkjet apparatus to which the present invention is applied.

FIG. 7 is an overall configuration diagram of the inkjet recording apparatus to which the present invention is applied. In FIG. 7, the inkjet recording apparatus includes an inkjet driving unit, an ink density control unit, and a recordingmediumconveyance control unit.

The inkjet driving unit includes an inkjet head 32, a liquid storage tank 43, an alternatingcurrent power supply 47 configured to supply an alternatingcurrent voltage to a piezoelectric element in the inkjet head 32, a control voltage power supply 33 configured to supply a voltage to a charging electrode for applying electrification charges to droplets and a deflecting electrode for deflecting the droplets, pumps 46 and 36 configured to supply liquid to and collect the liquid from the inkjet head 32, and a main control device 37 configured to control operations of the units.

The ink density control unit adjusts the density of the liquid in the liquid storage tank 43 to be supplied to the inkjet head 32. Specifically, the ink density control unit includes a density measuring device 40 functioning as means for measuring liquid density in the liquid storage tank 43, a solvent storage tank 41 configured to store a liquid solvent used for diluting the liquid in the liquid storage tank 43, a pump 42 configured to supply the solvent in the solvent storage tank 41 to the liquid storage tank 43 of the inkjet driving unit, and an ink density control device 39 for controlling the density measuring device 40, the solvent storage tank 41, and the pump 42.

The recording medium conveyance control unit includes a recording medium conveying mechanism 45 and a conveyance control device 44.

In the configuration, upon receiving, from the outside, pattern data (not shown in the figure) to be recorded, the main control device 37 of the inkjet driving unit controls the liquid supply and collection pumps 46 and 36, the piezoelectric element driving alternating current power supply 47, and the control voltage power supply 33, which supplies a charging voltage and a deflecting voltage, to thereby output, according to the pattern data to be recorded, a charging electrode signal voltage to a charging electrode unit (not shown in the figure) and output a deflecting electrode signal voltage to a deflecting electrode (not shown in the figure). The main control device 37 controls ejection of the liquid (ink).

The main control device 37 of the inkjet driving unit communicates with the conveyance control device 44 of the recording medium conveyance control unit to perform handling of a printing body 16. Further, the main control device 37 of the inkjet driving unit communicates with the ink density control device 39 of the ink density control unit, confirms that the liquid density in the liquid storage tank 43 is predetermined density, and performs control to supply the liquid having the predetermined density to the inkjet head 32.

However, a configuration may be adopted in which, in the inkjet head 32, a droplet shape observing device 49 is set in an ink formation region, information obtained by the droplet shape observing device 49 is fed back to the main control device 37, and a proper input value calculated on the basis of the fed back information is input to the piezoelectric element, whereby stability of uniform ejection of the ink is realized.

First Embodiment

An embodiment of the present invention explained below is an example in which the present invention is applied to a continuous ejection type inkjet recording apparatus, which is a type of the inkjet recording apparatus shown in FIG. 7.

In particular, a schematic structure of a charging electrode and deflecting electrode configuration of an inkjet head in the continuous ejection type inkjet recording apparatus (or a continuous inkjet apparatus) according to the first embodiment of the present invention is explained.

Figure 1:
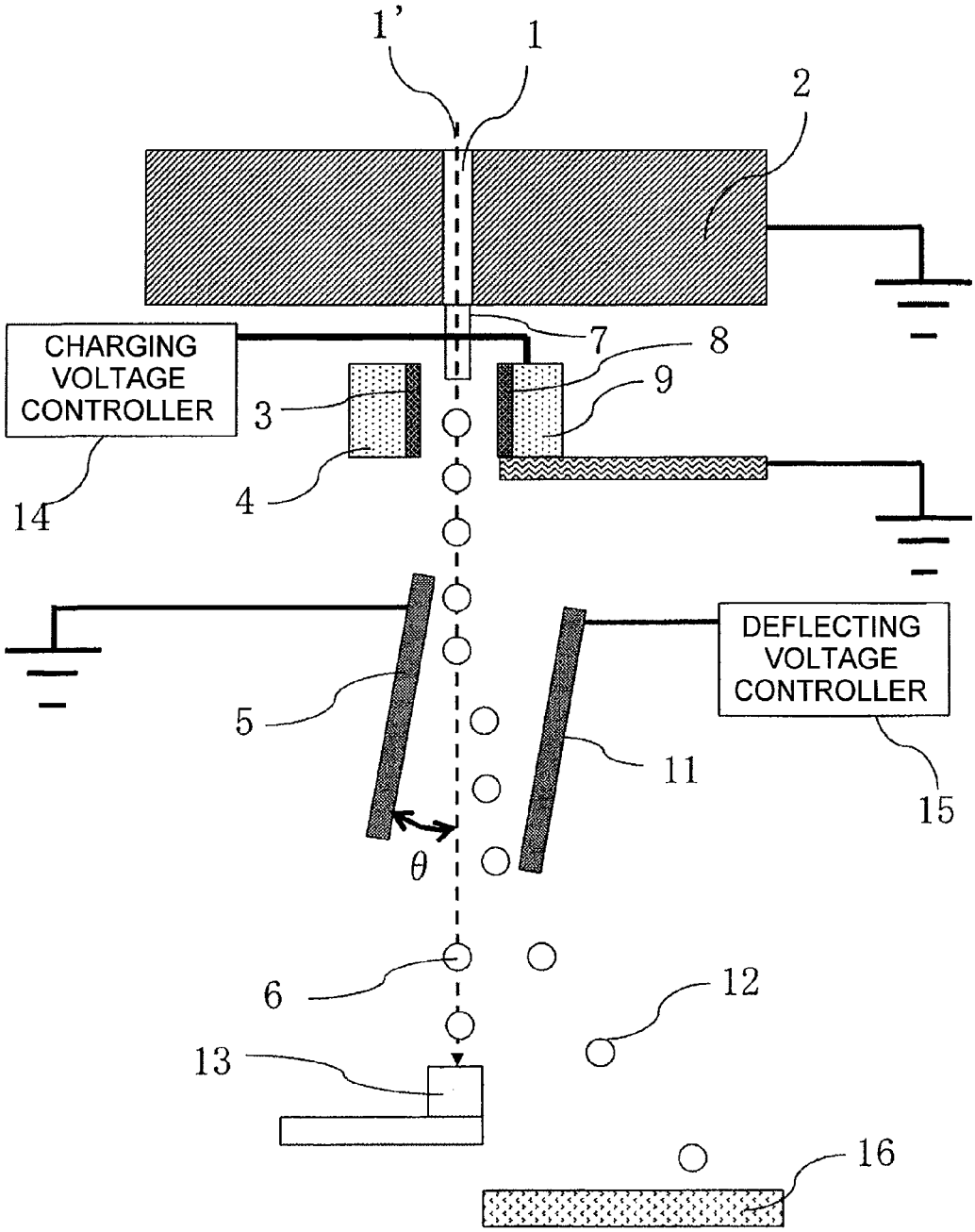
FIG. 1 is a main part configuration diagram of a continuous ejection type inkjet recording apparatus according to a first embodiment of the present invention.

FIG. 1 is a main part schematic configuration diagram of the first embodiment of the present invention. In FIG. 1, an internal configuration of the inkjet head 32 shown in FIG. 7 is shown.

In FIG. 1, the inkjet head of the continuous ejection type inkjet recording apparatus according to the first embodiment includes a nozzle head 2 configured to eject droplets, a pair of charging electrodes 3 and 8 for individually charging formed droplets; a pair of deflecting electrodes 5 and 11 for deflecting the charged droplets according to an electric field, and a gutter 13 configured to collect the droplets in order to reuse the droplets not used for printing.

The deflecting electrode 5 inclines to expand in a traveling direction of ink droplets by an angle θ with respect to an ink incident line 1'. The deflecting electrodes 5 and 11 are set to have opposed surfaces that are parallel to each other.

Figure 2:
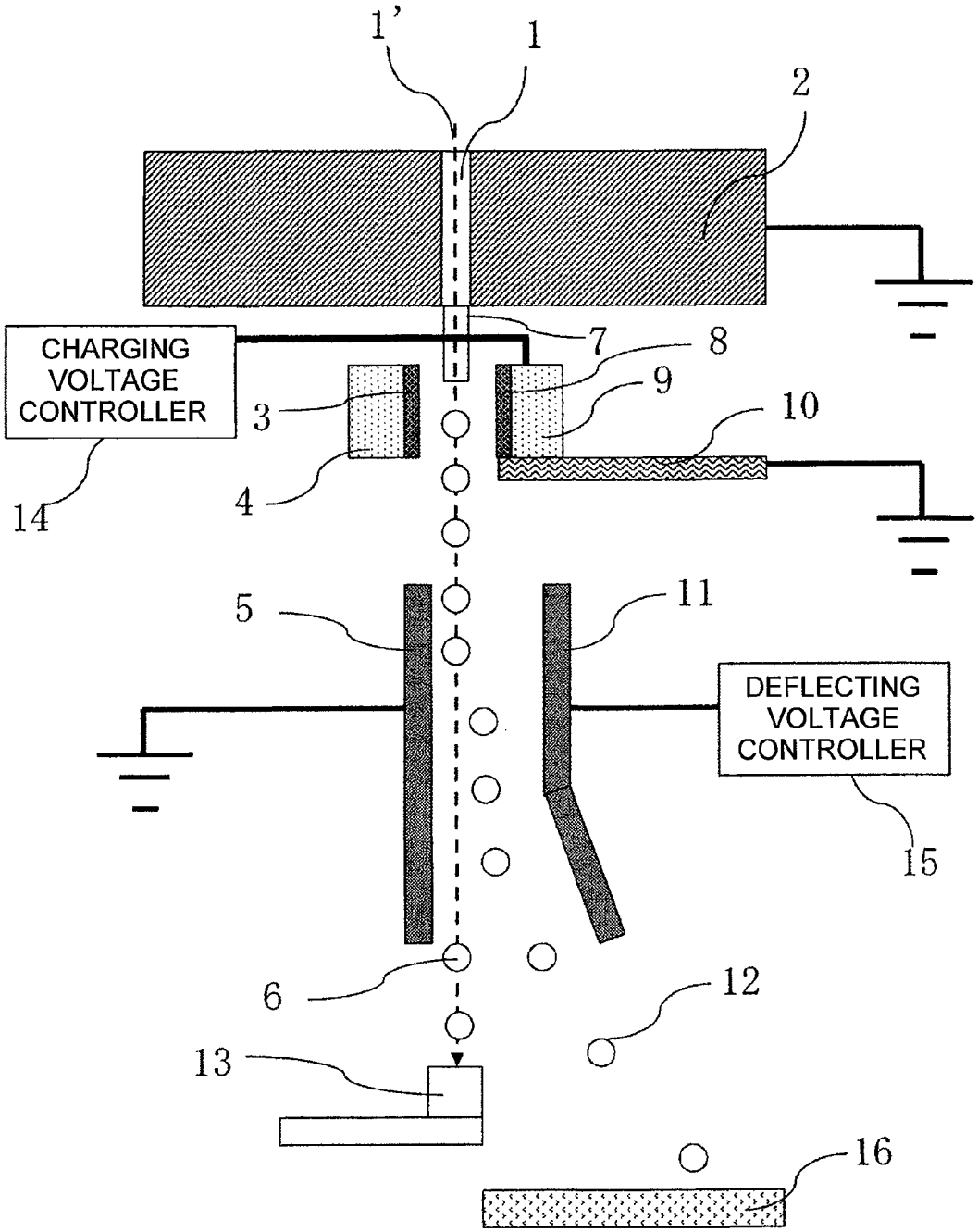
FIG. 2 is a main part configuration diagram of an example different from the present invention for comparison with the present invention.

FIG. 2 is a diagram showing an example (an example in the past) different from the present invention, which is a comparative example for comparison with the present invention. As shown in the comparative example of FIG. 2, on an ink input side, the deflecting electrodes 5 and 11 are set in parallel to the ink incident line 1'. On an ink ejection side, the deflecting electrodes 5 and 11 incline in a direction in which a space between the deflecting electrodes 5 and 11 increases.

In the configuration shown in FIG. 1, a liquid column 7 ejected from nozzles of the nozzle head 2 is cut by vibration applied from an upper part of an ink chamber 1 in the nozzle head 2. As shown in the figure, the liquid column 7 forms a droplet row. An entire housing of the nozzle head 2 is in a grounded state. The formed droplets are charged by the charging electrodes 3 and 8 formed on charging electrode boards 4 and 9 and arranged close to each other to be parallel to a flying direction of the liquid droplets.

A charging voltage controller 14 inputs (applies) an arbitrary voltage to the droplets at arbitrary timing, whereby the charging electrodes 3 and 8 can charge the respective droplets according to a target printing form.

At this point, a cut point of the liquid column 7 (liquid droplets are formed by the cutting of the liquid column 7) is located on the charging electrodes 3 and 8 provided to corresponding to the liquid droplet row. The charging electrodes 3 and 8 are desirably arranged such that the droplet row passes the vicinity of the center in the width direction of the charging electrodes 3 and 8 (a direction perpendicular to the paper surface of the figure).

In a lower part in an ink flying direction in a charging process (below the charging electrodes 3 and 8), so-called deflecting electrodes that form a deflecting electric field for deflecting charged droplets 12 in an arbitrary direction according to an electric field are set. The deflecting electrodes include the grounded deflecting electrode 5 (a first deflecting electrode) and the high voltage deflecting electrode 11 (a second deflecting electrode). The deflecting electrodes are arranged such that the grounded deflecting electrode 5 and the high voltage deflecting electrode 11 are opposed in parallel to each other.

Specifically, a voltage is applied to between the deflecting electrodes 5 and 11 from the deflecting voltage controller 15, whereby an electric field is formed between the grounded deflecting electrode 5 and the high voltage deflecting electrode 11 in a direction perpendicular to electrode surfaces. In particular, when the ink droplets are negatively charged, a positive voltage is applied to the high voltage deflecting electrode 11. Therefore, an electric line of force is generated from the direction perpendicular to the electrode surface of the deflecting electrode 5 and made perpendicularly incident on the electrode surface of the deflecting electrode 11. Since the deflecting electrodes 5 and 11 are parallel to each other, a plurality of electric lines of force are formed perpendicularly to the electrode surfaces of the deflecting electrodes 5 and 11 and in parallel to one another.

The droplets (including charged droplets and uncharged droplets) after passing the charging electrodes 3 and 8 fly in a region where this deflecting electric field is formed, whereby the charged droplets 12 are deflected by the influence of the deflecting electric field in a direction in which the charged droplets 12 approach the electrode 11 having opposite charging polarity. The charged droplets 12 arrive at the printing body 16 and form a printing pattern. Since the droplets having a large charging amount approach the positive side electrode, the ink incident line 1' is set in a position near the surface of the grounded deflecting electrode 5 in order to print a large character.

At this point, in the first embodiment of the present invention, a deflecting electric field E formed by the deflecting electrodes 5 and 11 and the ink droplet incident line 1' are not perpendicular to each other. Therefore, force $q \cdot E \cdot \sin(\theta)$ in the ink incident line 1' direction and force $q \cdot E \cdot \cos(\theta)$ in the direction perpendicular to the ink incident line 1' act on the charged droplets according to a droplet charging amount q, the electric field E, and an angle θ formed by the ink incident line 1' and the deflecting electrode 5. As a result, the charged droplets accelerate. The electric line of force formed between the deflecting electrodes 5 and 11 travels from the deflecting electrode 11 to the deflecting electrode 5 at an angle −θ with respect to a straight line orthogonal to the ink droplet incident line 1'.

When the mass of the droplets is represented as m, the acceleration in the ink incident line 1' acting on the charged droplets is $q \cdot (E/m) \sin(\theta)$. A force in the downward direction in FIG. 1 acts on the charged droplets.

On the other hand, in the example shown in FIG. 2, which is a comparative example, since θ is 0 degree, no force acts in the ink incident line direction (the downward direction in FIG. 1). Therefore, the leading droplet decelerates because of air resistance. However, the air resistance to the following droplet is weak and the following droplet decelerates slowly because the following droplet is present in the shadow (a split stream) of the leading droplet. Therefore, the distance between the droplets decrease and the following droplet catches up and combines (merges) with the leading droplet or disperses (scatters) with Coulomb repulsion to cause printing distortion.

In the first embodiment of the present invention shown in FIG. 1, the charged droplets accelerate in the ink incident line 1' direction. Therefore, since the distance between the droplets does not decrease or is kept at the minimum distance, the merge or the scatter does not occur. The merge or the scatter is sufficiently prevented when the uncharged droplet flies behind the charged leading droplet. The uncharged droplet 6 is collected by a gutter 13.

When two droplets respectively having charging amounts q1 and q2 continuously fly, accelerations $q1 \cdot (E/m) \sin(\theta)$ and $q2 \cdot (E/m) \sin(\theta)$ respectively act in the ink incident line direction 1'. Therefore, if the charging amounts are controlled to be $q1 \geq q2$ by the charging voltage controller 14, the following charged droplet does not catch up with the preceding charged droplet.

The same applies when two or more droplets fly. In the case of n charged droplets, charging amounts only have to be set as $q1 \geq q2 \geq q3 \geq \ldots \geq qn$. This is equivalent to printing on the printing body 16 in order from a dot 1 having a large deflection amount to a dot n having a small deflection amount.

The angle θ between the ink incident line 1' and the deflecting electrode 5 is adjusted and designed according to an electric field and a charging amount and the mass of droplets. In an apparatus used for general print recording, 1 degree to degrees is desirable (1 degree to 5 degrees is more desirable). As the length dimension of the electrodes 5 and 11, for example, about 27.5 mm is desirable. As the space between the electrodes 5 and 11, about 3 mm is desirable. In the example shown in FIG. 1, the grounded deflecting electrode 5 is shown on the left side and the high voltage deflecting electrode 11 is shown on the right side of the figure. However, concerning voltages applied to the deflecting electrodes, conversely, the deflecting electrode 11 may be grounded and the deflecting electrode 5 may be set to a negative voltage. It goes without saying that, when the ink droplets are positively charged, plus and minus of the voltages of the deflecting electrodes are opposite.

Further, the angle of the ink incident line 1' may be set such that the space between the deflecting electrode 5 and the ink incident line 1' increases toward the traveling direction of the droplets.

Between the charging electrodes 3 and 8 and the deflecting electrodes 5 and 11, an electric field shield member 10 is set for blocking the influence of the electric field from the high voltage deflecting electrode 11. The electric field shield member 10 is formed of a conductive member. As shown in FIG. 1, the electric field shield member 10 is desirably grounded not to exert the influence of the electric field by the high voltage to the charging electrodes 3 and 8 and the peripheries of the charging electrodes 3 and 8.

With such a configuration, since the distance between the charged droplets does not decrease, the printing distortion is small and it is unnecessary to insert dummy uncharged droplets among the charged droplets. Therefore, there is an effect that high speed printing is possible. Specifically, there is an effect that double sprinting speed can be obtained compared with the configuration in the past in which the dummy uncharged droplets are inserted among the charged droplets for printing.

As explained above, according to the first embodiment of the present invention, it is possible to realize the inkjet recording apparatus that can perform high speed printing without printing distortion.

Second Embodiment

A second embodiment of the present invention is explained.

Figure 3:
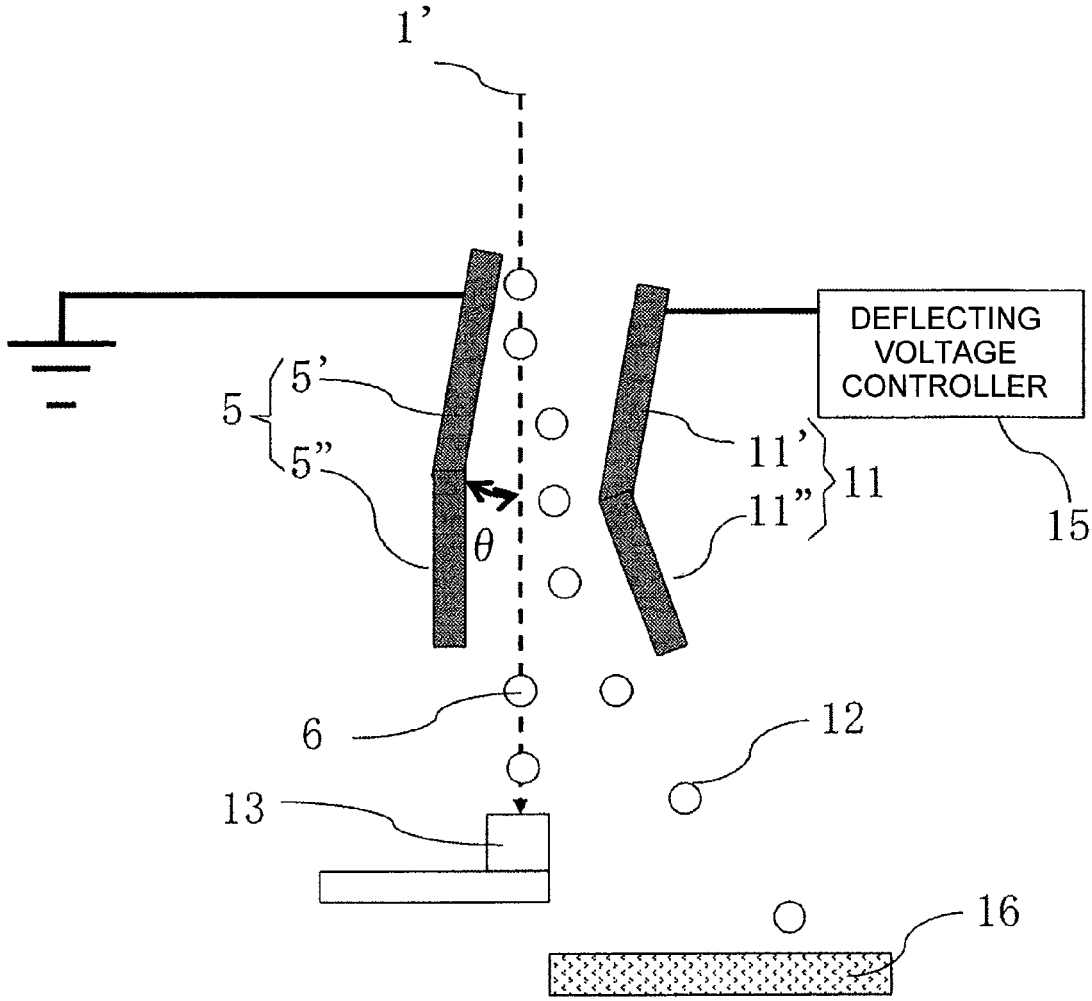
FIG. 3 is a main part configuration diagram of a continuous ejection type inkjet recording apparatus according to a second embodiment of the present invention.

FIG. 3 is a main part configuration diagram of the second embodiment of the present invention. Components not shown in FIG. 3 are the same as the components in the example shown in FIG. 1.

In FIG. 3, the deflecting electrode 5 includes a portion 5' (an inclining electrode surface) inclining at an angle θ with respect to the ink incident line 1' and a portion 5" (a parallel electrode surface) parallel to the ink incident line 1'. The deflecting electrode 11 includes a portion 11' (a first inclining electrode surface) parallel to the deflecting electrode 5' and a portion 11" (a second inclining electrode surface) inclining to separate from the ink incident line 1'. With such a configuration, since the charged droplets 12 do not collide with the deflecting electrode 11", there is an effect that it is possible to increase the height of printing (form a larger character).

The deflecting electrode 11" can also be set to 0 degree with respect to the ink incident line 1', i.e., in parallel to the ink incident line 1'. The length dimension of the portion 5" is desirably a dimension equal to or smaller than a half of the length dimension of the portion 5'. Similarly, the length dimension of the portion 11" is desirably equal to or smaller than a half of the length dimension of the portion 11'.

According to the second embodiment of the present invention, it is possible to obtain effects same as the effects of the first embodiment. Further, it is possible to form a large character.

Third Embodiment

A third embodiment of the present invention is explained.

Figure 4:
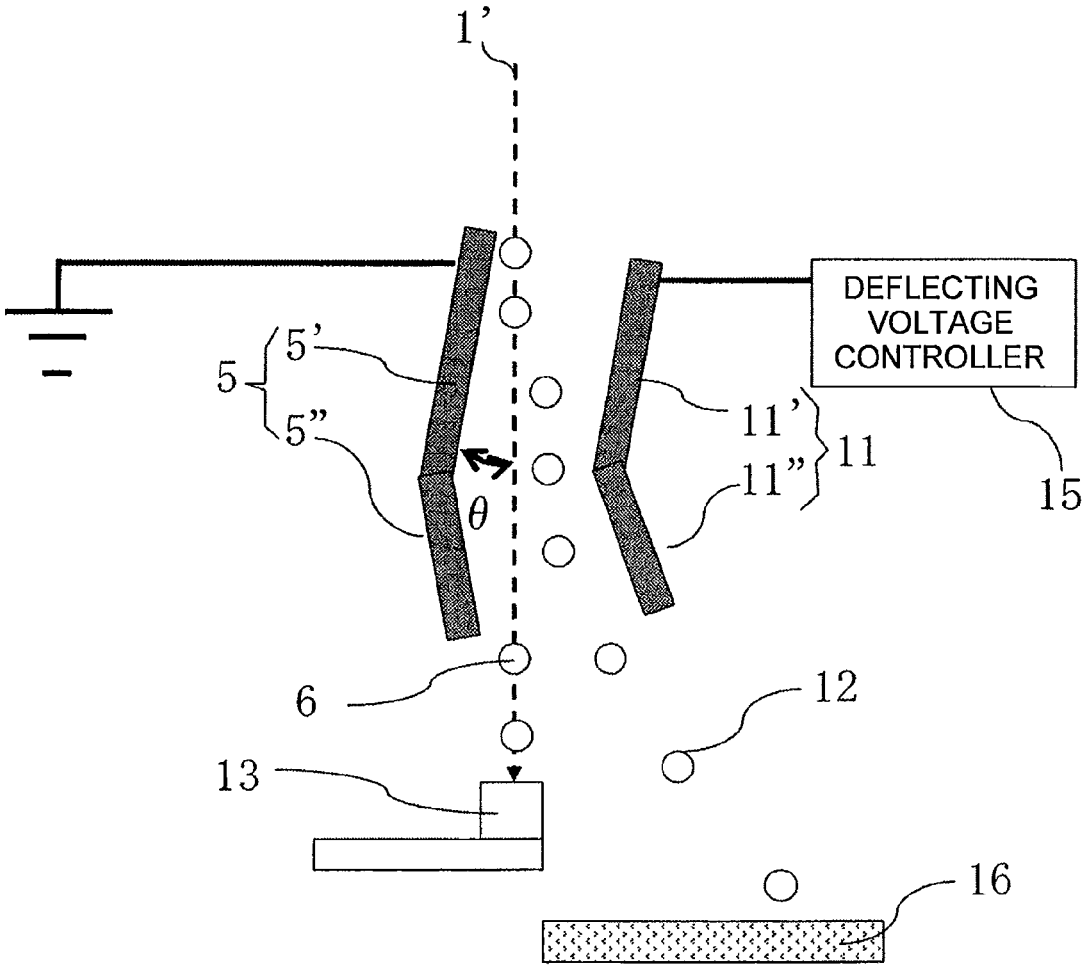
FIG. 4 is a main part configuration diagram of a continuous ejection type inkjet recording apparatus according to a third embodiment of the present invention.

FIG. 4 is a main part configuration diagram of the third embodiment of the present invention. Components not shown in FIG. 4 are the same as the components in the example shown in FIG. 1.

In FIG. 4, the deflecting electrode 5 includes a portion 5' (a first inclining electrode surface) inclining at an angle θ with respect to the ink incident line 1' and a portion 5" approaching the ink incident line 1' (a second inclining electrode surface inclining such that a space between the second inclining electrode surface and an extended line in an ink droplet incident direction gradually decreases). The deflecting electrode 11 includes a portion 11' (a first inclining electrode surface) parallel to the deflecting electrode 5' and a portion 11" (a second inclining electrode surface) inclining to separate from the ink incident line 1'. The portion 5" and the portion 11" are desirably formed to be parallel to each other. The length dimension of the portion 5" is desirably a dimension equal to or smaller than a half of the length dimension of the portion 5'. Similarly, the length dimension of the portion 11" is desirably equal to or smaller than a half of the length dimension of the portion 11'.

With such a configuration, an electric field between the deflecting electrode 5" and the deflecting electrode 11" does not weaken compared with an electric field between the portion 5' and portion 11' parallel to the portion 5'. Therefore, there is an effect that it is possible to increase deflection width of printing and reduce the distance from the high deflecting electrodes 5 and 11 to the printing body 16.

According to the third embodiment of the present invention, it is possible to obtain effects same as the effects of the first embodiment. Further, it is possible to reduce the distance from the high deflecting electrodes 5 and 11 to the printing body 16 and reduce the size of the continuous ejection type inkjet recording apparatus.

Fourth Embodiment

A fourth embodiment of the present invention is explained.

Figure 5:
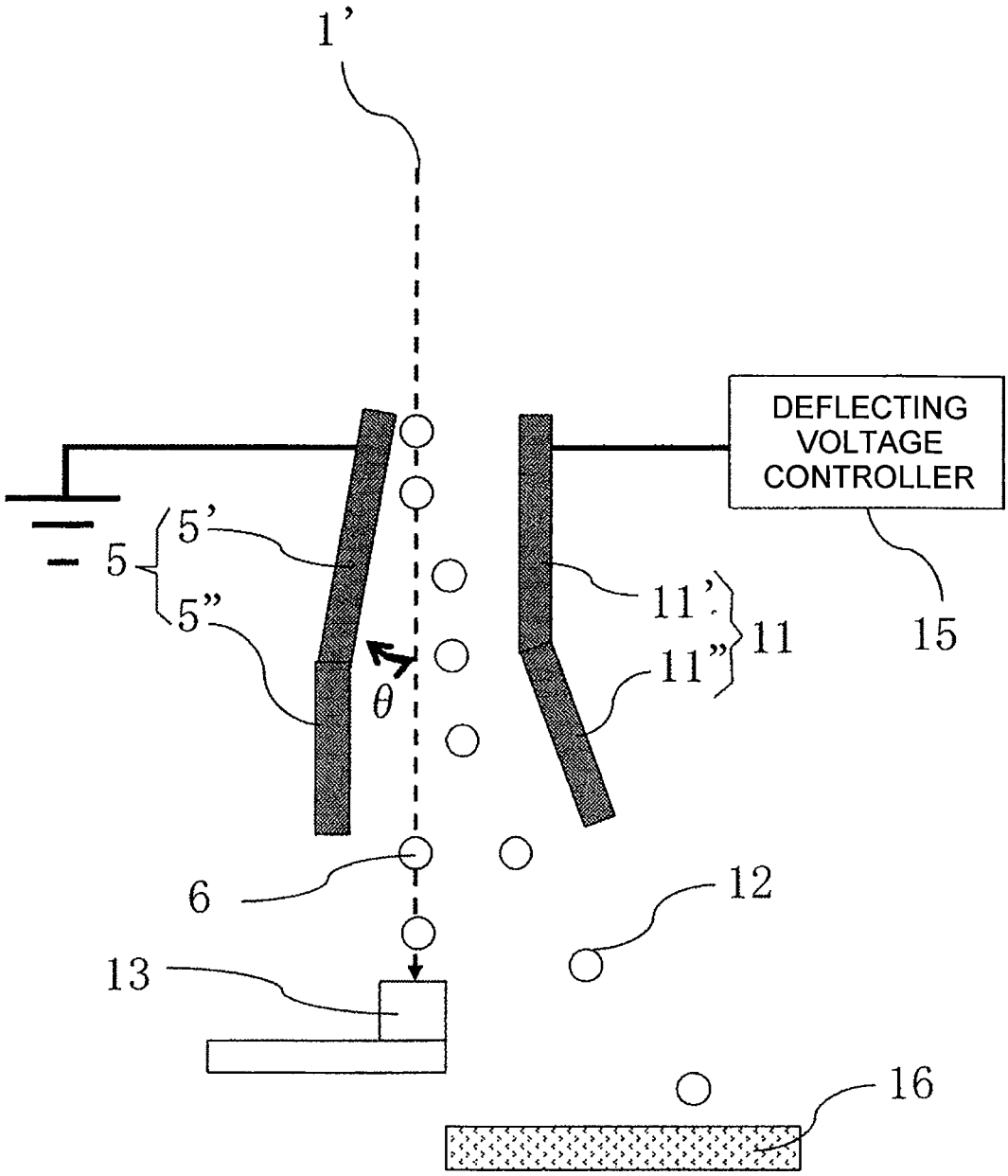
FIG. 5 is a main part configuration diagram of a continuous ejection type inkjet recording apparatus according to a fourth embodiment of the present invention.

FIG. 5 is a main part configuration diagram of the fourth embodiment of the present invention. Components not shown in FIG. 5 are the same as the components in the example shown in FIG. 5.

In FIG. 5, the deflecting electrode 5 includes a portion 5' (an inclining electrode surface) inclining at an angle θ with respect to the ink incident line 1' and a portion 5" (a parallel electrode surface) parallel to the ink incident line 1'. The deflecting electrode 11 includes a portion 11' (a parallel electrode surface) parallel to the ink incident line 1' and a portion 11" (an inclining electrode surface) inclining to separate from the ink incident line 1'. The deflecting electrode 11" can also be set to 0 degree with respect to the ink incident line 1', i.e., in parallel to the ink incident line 1'. The length dimension of the portion 5" is desirably a dimension equal to or smaller than a half of the length dimension of the portion 5'. Similarly, the length dimension of the portion 11" is desirably equal to or smaller than a half of the length dimension of the portion 11'.

With such a configuration, since a joining section of the deflecting electrode 11' and the deflecting electrode 11" separates from the deflecting electrode 5'. Therefore, there is an effect that it is possible to further increase the printing height.

According to the fourth embodiment of the present invention, it is possible to obtain effects same as the effects of the first embodiment. Further, it is possible to form a larger character.

Fifth Embodiment

A fifth embodiment of the present invention is explained.

Figure 6:
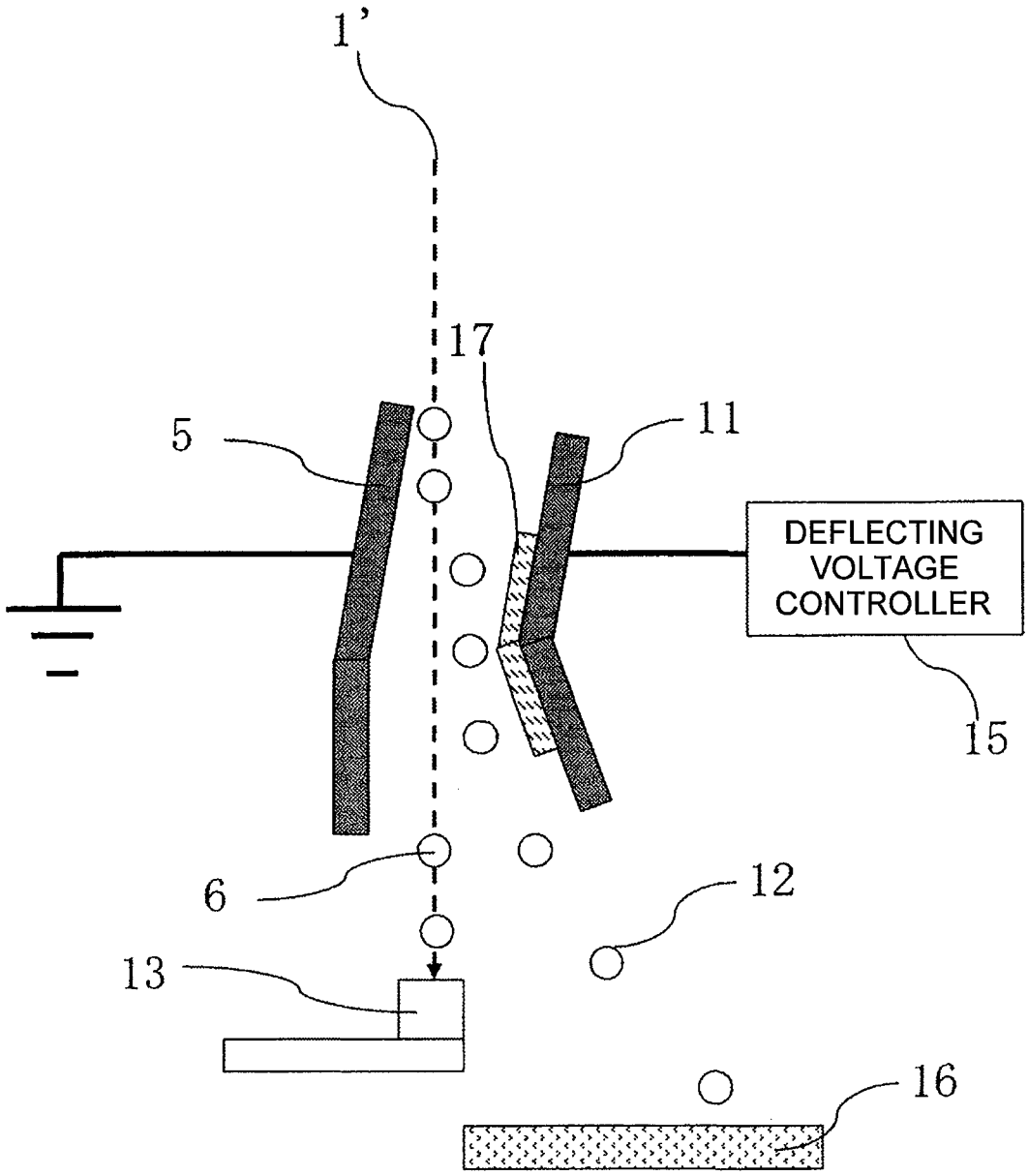
FIG. 6 is a main part configuration diagram of a continuous ejection type inkjet recording apparatus according to a fifth embodiment of the present invention.

FIG. 6 is a main part configuration diagram of the fifth embodiment of the present invention. Components not shown in FIG. 6 are the same as the components in the example shown in FIG. 6.

In FIG. 6, a bending section of the deflecting electrode 11, i.e., a surface opposed to the deflecting electrode 5 in a joining section of the deflecting electrodes 11' and 11" is covered with a dielectric 17. The other components are the same as the components of the example shown in FIG. 5.

The dielectric body 17 may cover a large portion of the deflecting electrode 11 opposed to the deflecting electrode 5. The dielectric 17 may be formed of a transparent dielectric, for example, resin having transparency such as acrylic, PET, or PEN or an inorganic material having transparency such as glass. With such a configuration, there is an effect that occurrence of abnormal discharge is prevented by the bending section of the deflecting electrode 11.

According to the fifth embodiment of the present invention, it is possible to obtain effects same as the effects of the fourth embodiment. Further, there is an effect that occurrence of abnormal discharge is prevented by the bending section of the deflecting electrode 11.

The dielectric 17 can also be formed in a joining portion of the portion 11' and the portion 11" of the deflecting electrode 11 in the second to fourth embodiments.

As explained above in detail, with the continuous ejection type inkjet recording apparatus and the continuous inkjet recording method in which the deflecting electrode inclines to expand from the ink incident line in the traveling direction, since the distance between the charged droplets does not decrease, the printing distortion decreases and it is unnecessary to insert dummy uncharged droplets among the charged droplets. Therefore, there is an effect that it is possible to perform highly accurate and quick printing.

What is claimed is:

1. An inkjet recording apparatus comprising:

a nozzle head configured to eject ink droplets;

a deflecting voltage controller configured to generate a recording signal corresponding to recording information;

a charging voltage controller configured to charge the ink droplets on the basis of the recording signal; and a deflecting unit including a first deflecting electrode and a second deflecting electrode opposed to each other, the charged ink droplets being made incident between the first deflecting electrode and the second deflecting electrode, the first deflecting electrode having a polarity the same as an electric polarity of the charged ink droplets, at least a part of the first deflecting electrode inclining with respect to an extended line in an ink droplet incident direction of the ink droplets made incident between the first deflecting electrode and the second deflecting electrode such that a space between the part of the first deflecting electrode and the extended line gradually increases, and the second deflecting electrode having a polarity opposite to the electric polarity of the charged ink droplets and deflecting the charged ink droplets, wherein an entire electrode surface of the first deflecting electrodes inclines such that the space between the electrode surface of the first deflecting electrode and the extended line in the ink droplet incident direction gradually increases, and wherein an electrode surface of the second deflection electrode is parallel to the electrode surface of the first deflecting electrode.

2. An inkjet recording apparatus comprising:

a nozzle head configured to elect ink droplets;

a deflecting voltage controller configured to generate a recording signal corresponding to recording information;

a charging voltage controller configured to charge the ink droplets on the basis of the recording signal; and a deflecting unit including a first deflecting electrode and a second deflecting electrode opposed to each other, the charged ink droplets being made incident between the first deflecting electrode and the second deflecting electrode, the first deflecting electrode having a polarity the same as an electric polarity of the charged ink droplets, at least a part of the first deflecting electrode inclining with respect to an extended line in an ink droplet incident direction of the ink droplets made incident between the first deflecting electrode and the second deflecting electrode such that a space between the part of the first deflecting electrode and the extended line gradually increases, and the second deflecting electrode having a polarity opposite to the electric polarity of the charged ink droplets and deflecting the charged ink droplets, wherein the first deflecting electrode includes a first inclining electrode surface inclining such that a space between the first inclining electrode surface and the extended line in the ink droplet incident direction gradually increases and a parallel electrode surface parallel to the extended line in the ink droplet incident direction, and wherein the second deflecting electrode includes a second inclining electrode surface parallel to the inclining electrode surface of the first deflecting electrode and a third inclining electrode surface inclining such that a space between the second inclining electrode surface and the extended line in the ink droplet incident direction gradually increases.

3. An inkjet recording apparatus comprising:

a nozzle head configured to elect ink droplets;

a deflecting voltage controller configured to generate a recording signal corresponding to recording information;

a charging voltage controller configured to charge the ink droplets on the basis of the recording signal; and a deflecting unit including a first deflecting electrode and a second deflecting electrode opposed to each other, the charged ink droplets being made incident between the first deflecting electrode and the second deflecting electrode, the first deflecting electrode having a polarity the same as an electric polarity of the charged ink droplets, at least a part of the first deflecting electrode inclining with respect to an extended line in an ink droplet incident direction of the ink droplets made incident between the first deflecting electrode and the second deflecting electrode such that a space between the part of the first deflecting electrode and the extended line gradually increases, and the second deflecting electrode having a polarity opposite to the electric polarity of the charged ink droplets and deflecting the charged ink droplets, wherein the first deflecting electrode includes a first inclining electrode surface inclining such that a space between the first inclining electrode surface and the extended line in the ink droplet incident direction gradually increases and a second inclining electrode surface inclining such that a space between the second inclining electrode surface and the extended line in the ink droplet incident direction gradually decreases, and wherein the second deflecting electrode includes a third inclining electrode surface parallel to the first inclining electrode surface of the first deflecting electrode and a fourth inclining electrode surface inclining such that a space between the second inclining electrode surface and the extended line in the ink droplet incident direction gradually increases.

4. An inkjet recording apparatus comprising:

a nozzle head configured to elect ink droplets;

a deflecting voltage controller configured to generate a recording signal corresponding to recording information;

a charging voltage controller configured to charge the ink droplets on the basis of the recording signal; and a deflecting unit including a first deflecting electrode and a second deflecting electrode opposed to each other, the charged ink droplets being made incident between the first deflecting electrode and the second deflecting electrode, the first deflecting electrode having a polarity the same as an electric polarity of the charged ink droplets, at least a part of the first deflecting electrode inclining with respect to an extended line in an ink droplet incident direction of the ink droplets made incident between the first deflecting electrode and the second deflecting electrode such that a space between the part of the first deflecting electrode and the extended line gradually increases, and the second deflecting electrode having a polarity opposite to the electric polarity of the charged ink droplets and deflecting the charged ink droplets, wherein the first deflecting electrode includes an inclining electrode surface inclining such that a space between the inclining electrode surface and the extended line in the ink droplet incident direction gradually increases and a parallel electrode surface parallel to the extended line in the ink droplet incident direction, and wherein the second deflecting electrode includes a parallel electrode surface parallel to the extended line in the ink droplet incident direction and an inclining electrode surface inclining such that a space between the inclining electrode surface and the extended line in the ink droplet incident direction gradually increases.

5. An inkjet recording apparatus comprising:

a nozzle head configured to eject ink droplets;

a deflecting voltage controller configured to generate a recording signal corresponding to recording information;

a charging voltage controller configured to charge the ink droplets on the basis of the recording signal; and a deflecting unit including a first deflecting electrode and a second deflecting electrode opposed to each other, the charged ink droplets being made incident between the first deflecting electrode and the second deflecting electrode, the first deflecting electrode having a polarity the same as an electric polarity of the charged ink droplets, at least a part of the first deflecting electrode inclining with respect to an extended line in an ink droplet incident direction of the ink droplets made incident between the first deflecting electrode and the second deflecting electrode such that a space between the part of the first deflecting electrode and the extended line gradually increases, and the second deflecting electrode having a polarity opposite to the electric polarity of the charged ink droplets and deflecting the charged ink droplets, wherein the first deflecting electrode includes an inclining electrode surface inclining such that a space between the inclining electrode surface and the extended line in the ink droplet incident direction gradually increases and a parallel electrode surface parallel to the extended line in the ink droplet incident direction, wherein the second deflecting electrode includes a parallel electrode surface parallel to the extended line in the ink droplet incident direction and an inclining electrode surface inclining such that a space between the inclining electrode surface and the extended line in the ink droplet incident direction gradually increases, and wherein the inkjet recording apparatus includes a dielectric that covers at least a joining surface of the parallel electrode surface and the inclining electrode surface of the second deflecting electrode.

6. The inkjet recording apparatus according to claim 2, wherein the inkjet recording apparatus includes a dielectric that covers at least a joining surface of the second inclining electrode surface and the third inclining electrode surface of the second deflecting electrode.

7. The inkjet recording apparatus according to claim 3, wherein the inkjet recording apparatus includes a dielectric that covers at least a joining surface of the third inclining electrode surface and the fourth inclining electrode surface of the second deflecting electrode.

* * * * *